US007950941B1

(12) United States Patent
Wang

(10) Patent No.: US 7,950,941 B1
(45) Date of Patent: May 31, 2011

(54) EXTENSION SOCKET ASSEMBLY

(76) Inventor: Tai-Yen Wang, Wugu Township (TW)

( * ) Notice: Subject to any disclaimer, the term of this patent is extended or adjusted under 35 U.S.C. 154(b) by 0 days.

(21) Appl. No.: 12/657,339

(22) Filed: Jan. 19, 2010

(51) Int. Cl.
*H01R 4/60* (2006.01)

(52) U.S. Cl. ..... 439/214; 439/652

(58) Field of Classification Search ..... 439/214, 439/502, 505, 650–652; 174/53
See application file for complete search history.

(56) References Cited

U.S. PATENT DOCUMENTS 5,582,522 A * 12/1996 Johnson ..... 439/214
6,443,772 B1 * 9/2002 Chen ..... 439/652
7,442,090 B2 * 10/2008 Mori et al. ..... 439/652
7,635,273 B2 * 12/2009 Buzil et al. ..... 439/214
* cited by examiner

*Primary Examiner* — Khiem Nguyen
(74) *Attorney, Agent, or Firm* — William E. Pelton, Esq.; Cooper & Dunham LLP

(57) ABSTRACT

An extension socket assembly has a housing, a first conductive strip, a second conductive strip, two plug tabs and a switch device. The first conductive strip is mounted in the housing. The second conductive strip is mounted in the housing and is composed of a front segment and a rear segment electrically disconnectable from the front segment. The plug tabs are connected to the housing and are respectively connected electrically to the first conductive strip and the front segment of the second conductive strip. The switch device has a switch connected electrically to the front segment and the rear segment of the second conductive strip with two switch wires. Accordingly, the extension socket assembly can be easily and convenient switched on or off by the extension switch device.

20 Claims, 7 Drawing Sheets

EXTENSION SOCKET ASSEMBLY

BACKGROUND OF THE INVENTION

1. Field of the Invention

The present invention relates to an extension socket assembly, and more particularly to an extension socket assembly having an extension switch device to switch on or off the extension socket assembly easily and conveniently.

2. Description of Related Art

An extension socket assembly has multiple sockets to connect with an outlet on a wall and multiple electrical devices to transmit and provide electrical power to the devices away from the outlet.

To prevent the electrical devices from overheated due to long time of plugging in the sockets in the extension socket assembly and to achieve a power-saving purpose, the electrical devices are always unplugged from the sockets. However, to unplug multiple electrical devices from the extension socket assembly is inconvenient and troublesome especially the extension socket assembly is always mounted on the ground. Although there is a switch mounted on a housing of a conventional extension socket assembly to allow a user to switch all of sockets simultaneously, to switch off an extension socket assembly that is mounted on a lower location, such as the ground is also convenient.

To overcome the shortcomings, the present invention tends to provide an extension socket assembly to mitigate or obviate the aforementioned problems.

SUMMARY OF THE INVENTION

The main objective of the invention is to provide an extension socket assembly having an extension switch device to switch on or off the extension socket assembly easily and conveniently. The extension socket assembly has a housing, a first conductive strip, a second conductive strip, two plug tabs and a switch device. The housing has at least one socket defined in the housing. The first conductive strip is mounted in the housing and corresponds to the at least on socket in the housing. The second conductive strip is mounted in the housing, corresponds to the at least on socket in the housing and is composed of a front segment and a rear segment electrically disconnectable from the front segment. The plug tabs are connected to the housing and are respectively connected electrically to the first conductive strip and the front segment of the second conductive strip. The switch device has a switch connected electrically to the front segment and the rear segment of the second conductive strip with two switch wires.

Other objects, advantages and novel features of the invention will become more apparent from the following detailed description when taken in conjunction with the accompanying drawings.

DETAILED DESCRIPTION OF PREFERRED EMBODIMENT

Figure 1:
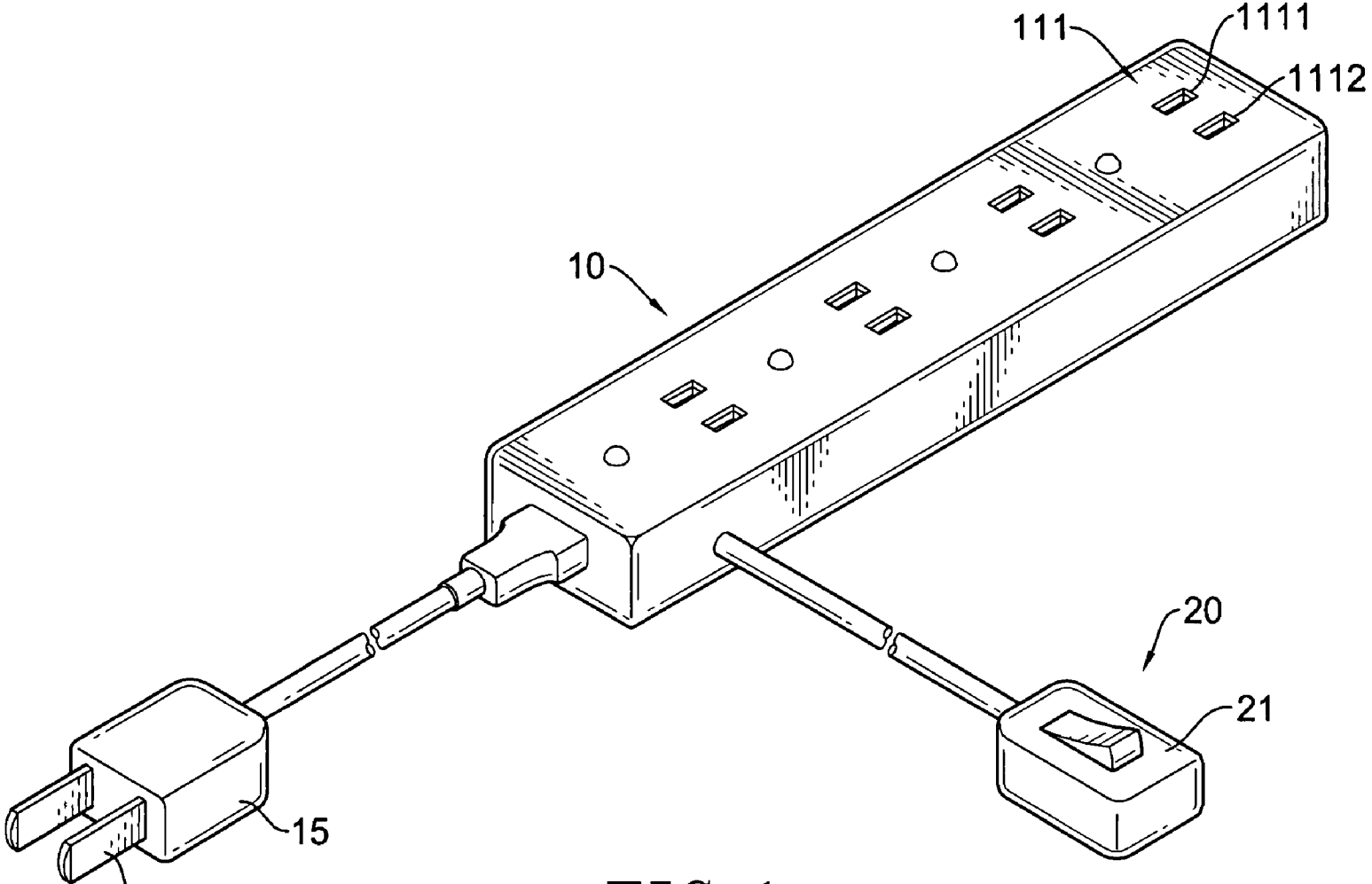
FIG. 1 is a perspective view of a first embodiment of an extension socket assembly in accordance with the present invention.
Figure 2:
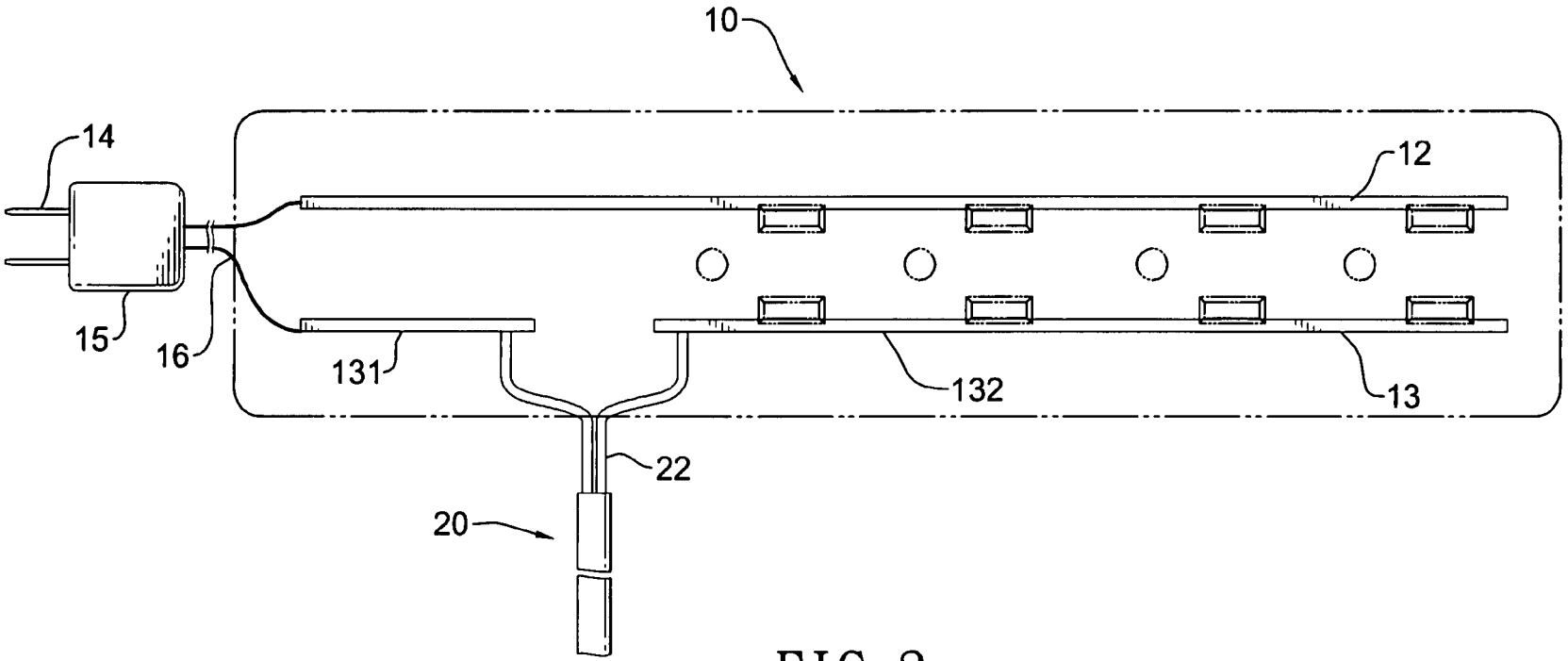
FIG. 2 is a top view of an internal structure of the extension socket assembly in FIG. 1.

With reference to FIGS. 1 and 2, an extension socket assembly in accordance with the present invention comprises a housing (10), a first conductive strip (12), a second conductive strip (13), two plug tabs (14) and an extension switch device (20). The housing (10) is hollow and has at least one socket (11) defined in the housing (10). Each socket (111) has at least two plug holes (1111,1112) to fit with plugs of electrical devices. Preferably, the housing (10) has four sockets (111) arranged in a line.

The first conductive strip (12) is mounted in the housing (10) and has at least one terminal formed on the first conductive strip (12) and corresponding respectively to the at least one socket (111) in the housing (10).

The second conductive strip (13) is mounted in the housing (10) and has at least one terminal formed on the second conductive strip (13) and corresponding respectively to the at least one socket (111) in the housing (10). The terminals on the conductive strips (12,13) correspond respectively to the plug holes (1111,1112) in the housing (10) to contact with plugs of electrical devices that are plugged into the sockets (111). The second conductive strip (13) is composed of a front segment (131) and a rear segment (132) electrically disconnectable from the front segment (131). The term of "electrically disconnectable" means that the rear segment (132) can be electrically connected with or disconnected from the front segment (131). In the first embodiment, the front segment (131) and the rear segment (132) of the second conductive strip (13) axe separate from each other to define a gap between the segments (131,132). The gap defined between the front and rear segments (131,132) of the second conductive strip (13) is at a position between an end of the housing (10) and the socket (111) that is nearest to the end of the housing (10). In an alternative embodiment, the gap defined between the front and rear segments (131,132) is at a position between adjacent two of the sockets (111).

The plug tabs (14) are connected to the end of the housing (10) that is adjacent to the gap between the front and rear segments (131,132) of the second conductive strip (13). The plug tabs (14) are respectively connected electrically to the first conductive strip (12) and the front segment (131) of the second conductive strip (13). In the first embodiment, the extension socket assembly further comprises a housing plug (15) on which the plug tabs (14) are mounted. The housing plug (15) is connected to the housing and connected respectively with the first conductive strip (12) and the front segment of the second conductive strip (13) by two plug wires (16). Accordingly, the plug tabs (14) are connected respectively to the first conductive strip (12) and the front segment (131) of the second conductive strip (13) by the plug wires (16).

The switch device (20) is connected to the housing (13) and has a switch (21) connected electrically to the front segment (131) and the rear segment (132) of the second conductive strip (13) with two switch wires (22).

When the switch (21) is switched on, the separated front and rear segments (131,132) of the conductive strip (13) can be connected electrically with each other via the switch wires (22) and the switch (21). Consequently, when the housing plug (15) with the plug tabs (14) is plugged into an outlet on a wall, the electrical power can be transmitted and provided to the electrical devices that are plugged in the sockets (111) via the conductive strips (12,13).

When the switch (21) is switched off, the separated front and the rear segments (131,132) are electrically disconnected from each other so that the electrical power is kept from being provided to the electrical devices. Accordingly, overheating and power consuming can be prevented.

Because the switch (21) is connected to the housing (10) with the switch wires (22), the switch (21) can be located or positioned at any convenient place away from the housing (10) to allow a user to operate the switch (21). Accordingly, the on/off control of the extension socket assemble is convenient.

Figure 3:
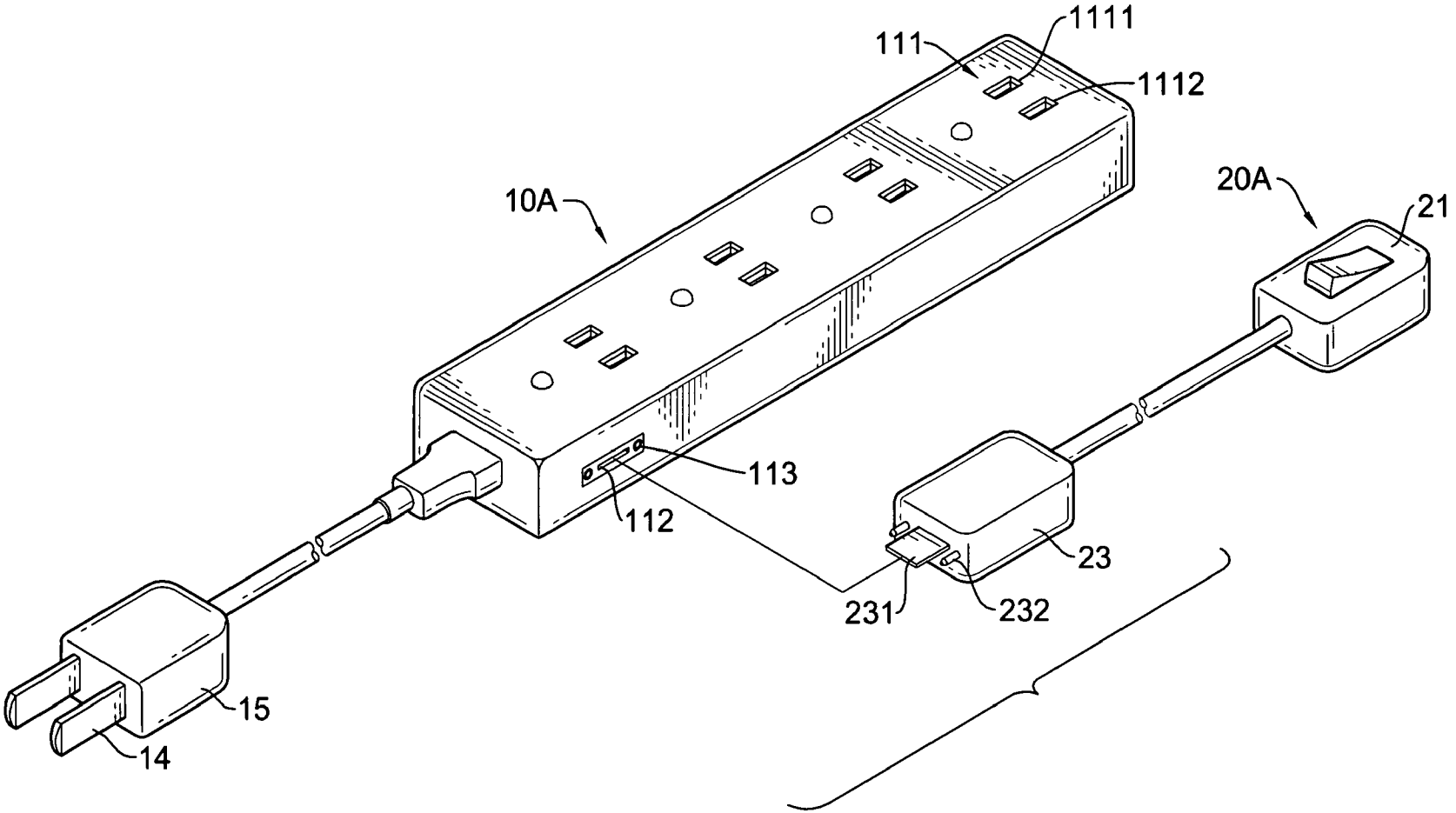
FIG. 3 is an exploded perspective view of a second embodiment of an extension socket assembly in accordance with the present invention.
Figure 4:
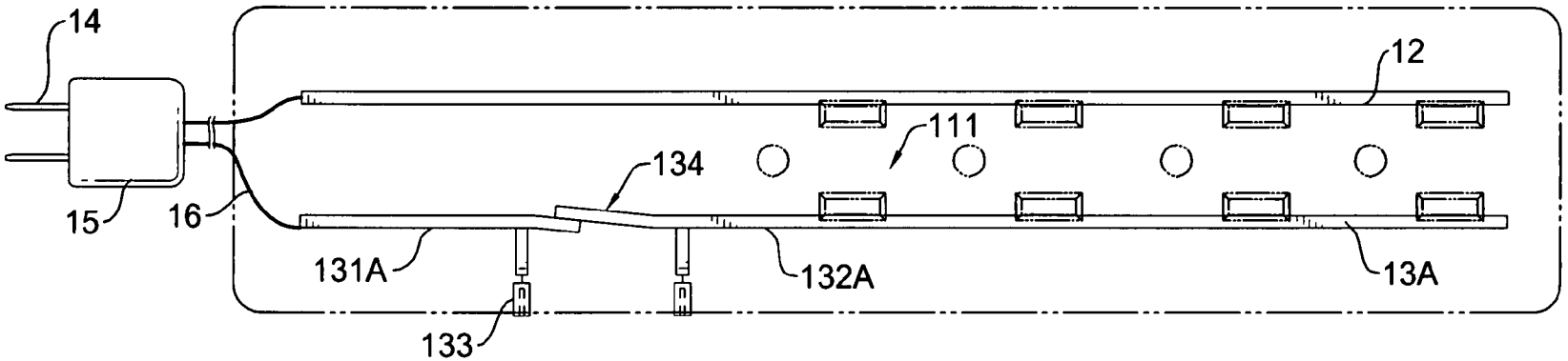
FIG. 4 is a top view of an internal structure of the extension socket assembly in FIG. 3.

With reference to FIGS. 3 and 4, in the second embodiment, the rear segment (132A) of the second conductive strip (13A) has a resilient end (134) contacting detachably with the front segment (131A). Two pin sockets (133) are mounted respectively on the front segment (131A) and the rear segment (132A). The housing (10A) further has a tab hole (112) and two pin holes (113). The tab hole (112) is defined in the housing (13) at a position corresponding to the resilient end (134) of the rear segment (132A). Preferably, the resilient end (134) of the rear segment (132A) is at a position between an end of the housing (10A) to which the housing plug (15) is connected and the socket (111) that is nearest to the end of the housing (10A) connected with the housing plug (15). The pin holes (113) are defined in the housing (10A) respectively at two sides of the tab hole (112) and align respectively with the pin sockets (133).

Figure 5:
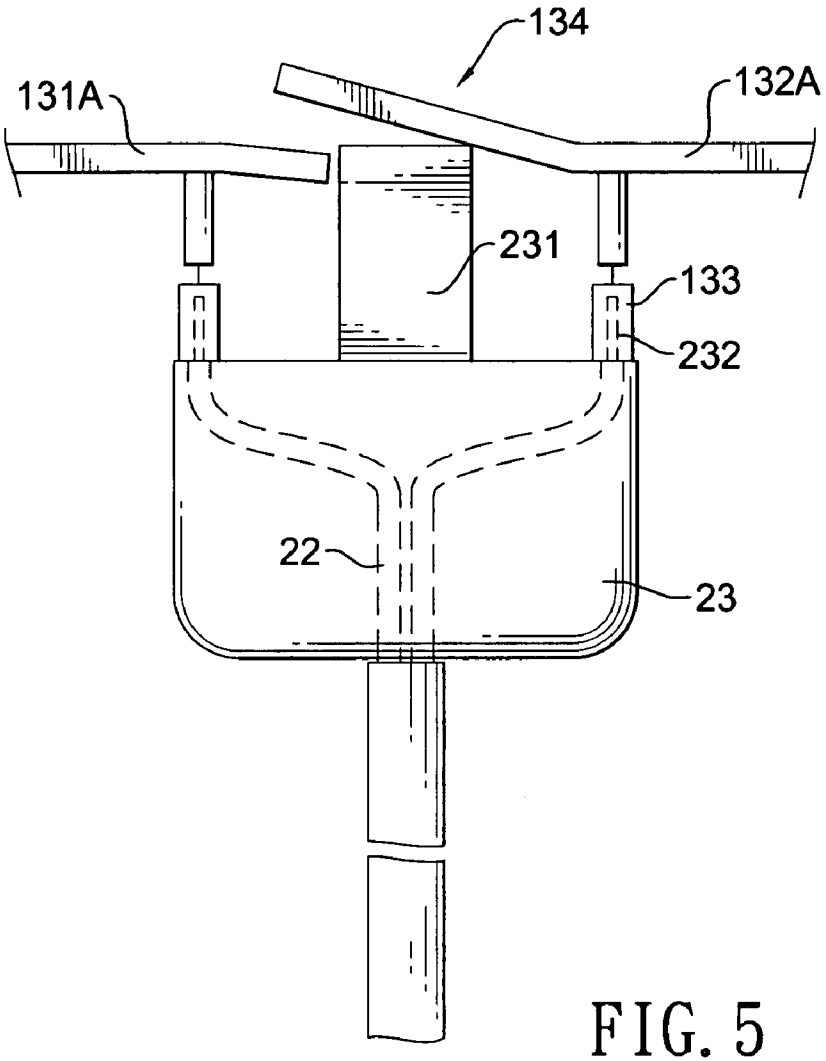
FIG. 5 is an enlarged top view of the switching plug and the segments of the second conductive strip of the extension socket assembly in FIG. 3.

The switch device (20A) further has a switching plug (23) attached detachably to the housing (10A) and has a detaching tab (231) and two contacting pins (232). The detaching tab (231) is mounted on the switching plug (23) and is inserted into the tab hole (112) in the housing (10A). With further reference to FIG. 5, when the detaching tab (231) is inserted into the tab hole (112), the detaching tab (231) pushes against the resilient end (134) to detach and disconnect the rear segment (132A) from the front segment (131A).

The contacting pins (232) are mounted on the switching plug (23), are inserted respectively into the pin holes (113) in the housing (10A) and are connected respectively with the switching wires (22). When the contacting pins (232) are inserted into the pin holes (113), the contacting pins (232) are inserted respectively into the pin sockets (133) on the front segment (131A) and the rear segment (132A) of the second conductive strip (13A).

Accordingly, when the switching plug (23) is plugged to the housing (10A), the detaching tab (231) and the contacting pins (232) are inserted respectively into the tab hole (112) and pin holes (113). The resilient end (134) of the rear segment (132A) is pressed against to detach and disconnect from the front segment (131A) by the detaching tab (231), and the contacting pins (232) contact respectively with the front segment (131A) and the rear segment (132A) of the second conductive strip (13) via the pin socket (133). After the switch (21) being switched on, the front and rear segments (131A, 132A) are connected electrically with each other via the pin socket (133), the contacting pins (232), the switch wires (22) and the switch (21). When the switched (21) is switched off, the front and rear segments (131A,132A) are disconnected electrically from each other.

After the switching plug (23) is unplugged from the housing (10A), the switch device (20A) can be detached from the housing (10A) and the resilient end (134) of the rear segment (132A) will rebound to contact with the front segment (131A) to make the front and rear segments (131A,132A) connecting electrically with each other. Accordingly, the extension socket assembly in accordance with the present invention can be served as an ordinary extension socket assembly.

With the resilient end (134) of the rear segment (132A) being at a position between an end of the housing (10A) and the nearest socket (111), all of the sockets (111) can be controlled to be switched on/off by the switch (21).

Figure 6:
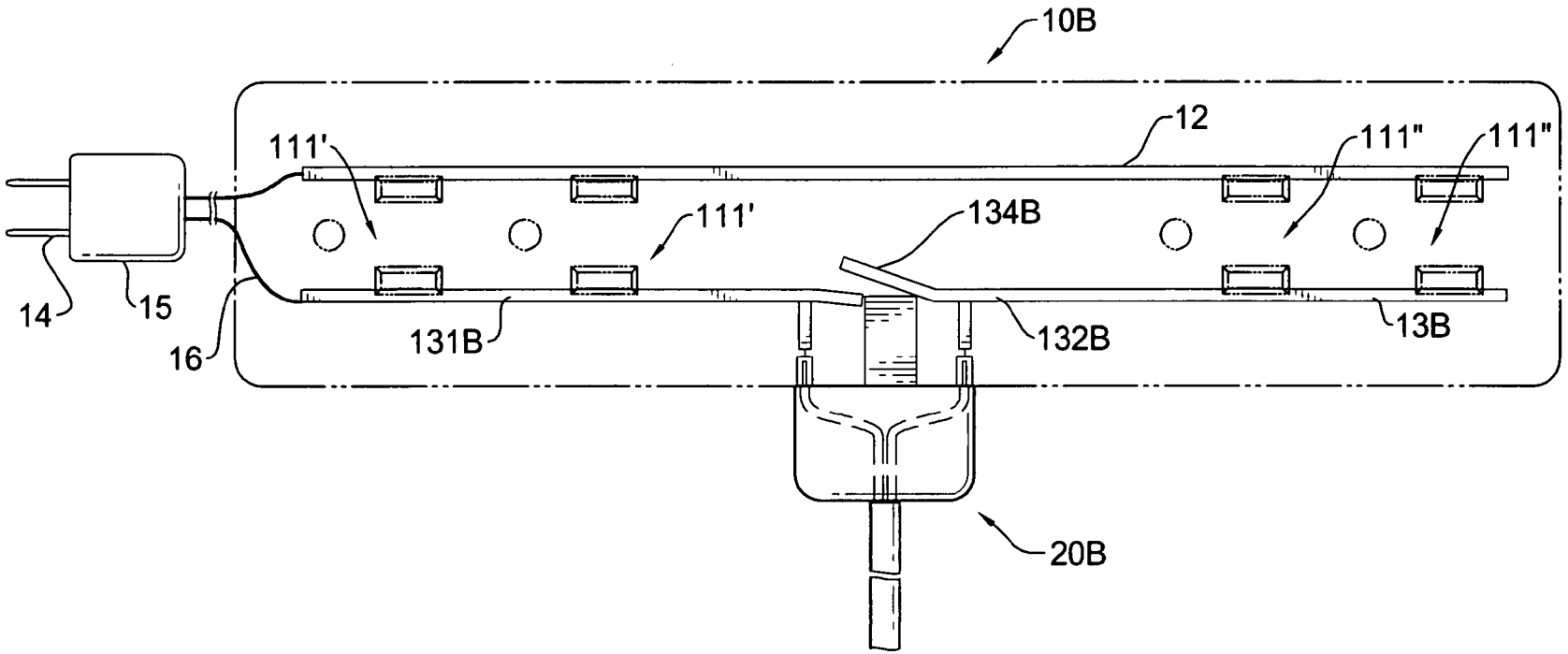
FIG. 6 is a top view of an internal structure of a third embodiment of an extension socket assembly in accordance with the present invention.

In the third embodiment as shown in FIG. 6, the resilient end (134B) of the rear segment (132B) of the second conductive strip (13B) is at a position between adjacent two of the sockets (111',111") in the housing (10B). Accordingly, some of the sockets (111') corresponding to the front segment (131B) of the second conductive strip (13B) are always kept at an electrically connecting condition with the first conductive strip (12) if a plug is inserted into the socket (111'), and the other sockets (111') can be controlled by the switch device (20B).

Figure 7:
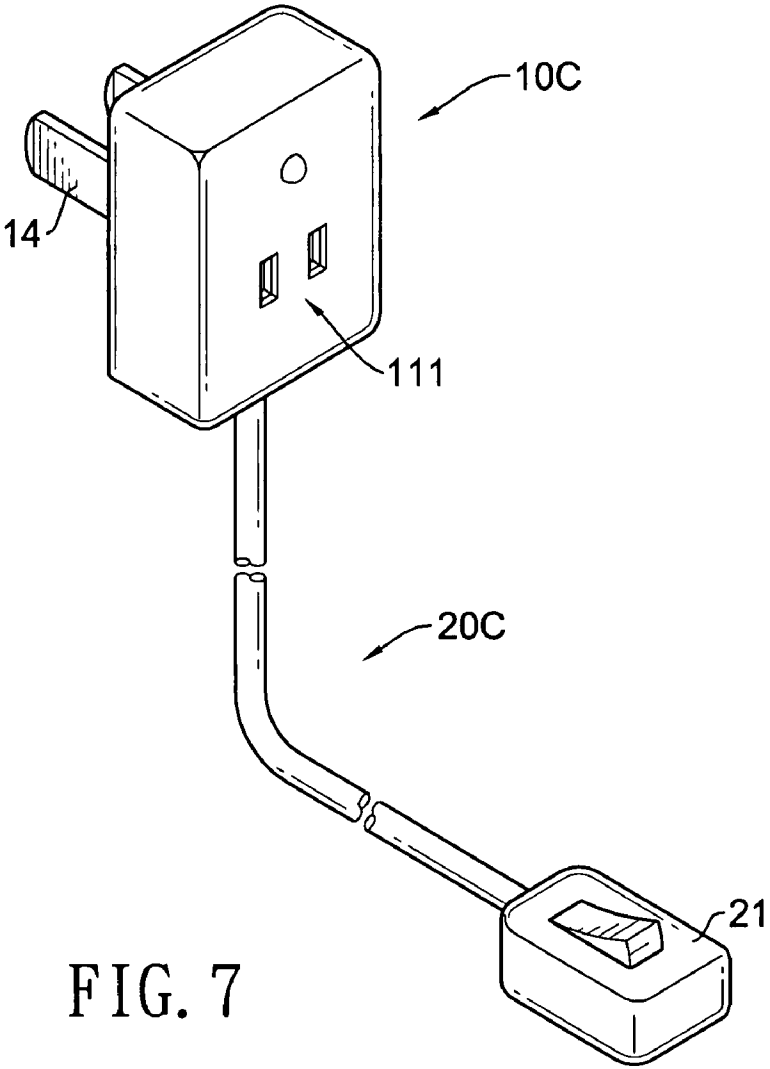
FIG. 7 is a perspective view of a fourth embodiment of an extension socket assembly in accordance with the present invention.

With reference to FIG. 7, in the fourth embodiment, the plug tabs (14) are mounted on the housing (10C) and are connected or attached with the first conductive strip and the front segment of the second conductive strip. If the extension socket assembly in accordance with the present invention is plugged into a socket of an outlet on another extension socket assembly or the wall, the socket assembly/outlet can be switched on or off by the switch (21) of the switch device (20C).

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An extension socket assembly comprising:

a housing having at least one socket defined in the housing;

a first conductive strip mounted in the housing and corresponding to the at least one socket in the housing;

a second conductive strip mounted in the housing, corresponding to the at least on socket in the housing and composed of a front segment and a rear segment electrically disconnectable from the front segment;

two plug tabs connected to the housing and respectively connected electrically to the first conductive strip and the front segment of the second conductive strip; and a switch device having a switch connected electrically to the front segment and the rear segment of the second conductive strip with two switch wires.

2. The extension socket assembly as claimed in claim 1 further comprising a housing plug connected to the housing and connected respectively with the first conductive strip and the front segment of the second conductive strip by two plug wires, wherein the plug tabs are mounted on the housing plug and are connected respectively to the plug wires.

3. The extension socket assembly as claimed in claim 2, wherein the front segment and the rear segment of the second conductive strip are separate from each other to define a gap between the segments; and the gap defined between the front and rear segments of the second conductive strip is at a position between an end of the housing to which the housing plug is connected and the socket that is nearest to the end of the housing connected with the housing plug.

4. The extension socket assembly as claimed in claim 1, wherein the plug tabs are mounted on the housing.

5. The extension socket assembly as claimed in claim 4, wherein the front segment and the rear segment of the second conductive strip are separate from each other to define a gap between the segments; and the gap defined between the front and rear segments of the second conductive strip is at a position between an end of the housing on which the plug tabs are mounted and the socket that is nearest to the end of the housing connected with the housing plug.

6. The extension socket assembly as claimed in claim 2, wherein the rear segment of the second conductive strip has a resilient end contacting detachably with the front segment of the second conductive;

two pin sockets are mounted respectively on the front segment and the rear segment of the second conductive strip; and the switch device further has a switching plug attached detachably to the housing and having a detaching tab mounted on the switching plug, inserted into the housing and pushing against the resilient end to detach and disconnect the rear segment from the front segment; and two contacting pins mounted on the switching plug, inserted into the housing, connected respectively with the switching wires and inserted respectively into the pin sockets on the front segment and the rear segment of the second, conductive strip.

7. The extension socket assembly as claimed in claim 6, wherein the resilient end of the rear segment is at a position between an end of the housing to which the housing plug is connected and the socket that is nearest to the end of the housing connected with the housing plug.

8. The extension socket assembly as claimed in claim 7, wherein the housing further has a tab hole defined in the housing and into which the detaching tab on the switching plug is inserted; and two pin holes defined in the housing respectively at two sides of the tab hole, aligning respectively with the pin sockets and into which the contacting pins on the switching plug are respectively inserted.

9. The extension socket assembly as claimed in claim 6, wherein the resilient end of the rear segment is at a position between adjacent two of the sockets in the housing.

10. The extension socket assembly as claimed in claim 9, wherein the housing further has a tab hole defined in the housing and into which the detaching tab on the switching plug is inserted; and two pin holes defined in the housing respectively at two sides of the tab hole, aligning respectively with the pin sockets and into which the contacting pins on the switching plug are respectively inserted.

11. The extension socket assembly as claimed in claim 4, wherein the rear segment of the second conductive strip has a resilient end contacting detachably with the front segment of the second conductive;

two pin sockets are mounted respectively on the front segment and the rear segment of the second conductive strip; and the switch device further has a switching plug attached detachably to the housing and having a detaching tab mounted on the switching plug, inserted into the housing and pushing against the resilient end to detach and disconnect the rear segment from the front segment; and two contacting pins mounted on the switching plug, inserted into the housing, connected respectively with the switching wires and inserted respectively into the pin sockets on the front segment and the rear segment of the second conductive strip.

12. The extension socket assembly as claimed in claim 11, wherein the resilient end of the rear segment is at a position between an end of the housing on which the housing plug tabs are mounted and the socket that is nearest to the end of the housing connected with the housing plug.

13. The extension socket assembly as claimed in claim 12, wherein the housing further has a tab hole defined in the housing and into which the detaching tab on the switching plug is inserted; and two pin holes defined in the housing respectively at two sides of the tab hole, aligning respectively with the pin sockets and into which the contacting pins on the switching plug are respectively inserted.

14. The extension socket assembly as claimed in claim 11, wherein the resilient end of the rear segment is at a position between adjacent two of the sockets in the housing.

15. The extension socket assembly as claimed in claim 14, wherein the housing further has a tab hole defined in the housing and into which the detaching tab on the switching plug is inserted; and two pin holes defined in the housing respectively at two sides of the tab hole, aligning respectively with the pin sockets and into which the contacting pins on the switching plug are respectively inserted.

16. The extension socket assembly as claimed in claim 1, wherein the front segment and the rear segment of the second conductive strip are separate from each other to define a gap between the segments; and the gap defined between the front and rear segments of the second conductive strip is at a position between an end of the housing and the socket that is nearest to the end of the housing.

17. The extension socket assembly as claimed in claim 1, wherein the rear segment of the second conductive strip has a resilient end contacting detachably with the front segment of the second conductive;

two pin sockets are mounted respectively on the front segment and the rear segment of the second conductive strip; and the switch device further has a switching plug attached detachably to the housing and having a detaching tab mounted on the switching plug, inserted into the housing and pushing against the resilient end to detach and disconnect the rear segment from the front segment; and two contacting pins mounted on the switching plug, inserted into the housing, connected respectively with the switching wires and inserted respectively into the pin sockets on the front segment and the rear segment of the second conductive strip.

18. The extension socket assembly as claimed in claim 17, wherein the resilient end of the rear segment is at a position between an end of the housing and the socket that is nearest to the end of the housing.

19. The extension socket assembly as claimed in claim 17, wherein the resilient end of the rear segment is at a position between adjacent two of the sockets in the housing.

20. The extension socket assembly as claimed in claim 17, wherein the housing further has a tab hole defined in the housing and into which the detaching tab on the switching plug is inserted; and two pin holes defined in the housing respectively at two sides of the tab hole, aligning respectively with the pin sockets and into which the contacting pins on the switching plug are respectively inserted.

* * * * *